US009573413B2

(12) United States Patent
Krusoe

(10) Patent No.: US 9,573,413 B2
(45) Date of Patent: Feb. 21, 2017

(54) PAINT CADDY

(71) Applicant: GJP Enterprises, LLC, Cleveland, OH (US)

(72) Inventor: Greg Krusoe, Chargrin Falls, OH (US)

(73) Assignee: GJP ENTERPRISES, LLC, Cleveland, OH (US)

( * ) Notice: Subject to any disclaimer, the term of this patent is extended or adjusted under 35 U.S.C. 154(b) by 0 days.

(21) Appl. No.: 15/258,354

(22) Filed: Sep. 7, 2016

(65) Prior Publication Data

US 2016/0375719 A1 Dec. 29, 2016

Related U.S. Application Data

(63) Continuation of application No. 13/891,346, filed on May 10, 2013, now Pat. No. 9,440,485.

(60) Provisional application No. 61/645,284, filed on May 10, 2012.

(51) Int. Cl.
*B44D 3/12* (2006.01)
*B44D 3/14* (2006.01)

(52) U.S. Cl.
CPC ..... *B44D 3/12* (2013.01); *B44D 3/126* (2013.01); *B44D 3/14* (2013.01)

(58) Field of Classification Search
None
See application file for complete search history.

(56) References Cited

U.S. PATENT DOCUMENTS 496,537 A 5/1893 Purrington
921,898 A * 5/1909 Schultz ..... A61M 5/1782 141/328
926,927 A 7/1909 Devol
958,255 A 5/1910 Koertner
1,008,856 A * 11/1911 Mosher ..... A45D 33/006 206/361
1,111,159 A 9/1914 Knox
1,451,206 A 4/1923 Dow
1,551,242 A * 8/1925 Dick ..... B44D 3/14 211/65
1,590,572 A 6/1926 Fredette
1,693,489 A 11/1928 McGillan
1,788,262 A 1/1931 Wiebusch
2,070,998 A 2/1937 Odom
2,250,646 A 7/1941 Metsch
2,436,924 A 3/1948 Hansen
2,536,419 A 1/1951 Brunell et al.
2,541,390 A 2/1951 Weigand
2,542,737 A 2/1951 Vogel
2,587,779 A 3/1952 Smith
(Continued)

OTHER PUBLICATIONS

Print out from TS Simms webpage; http://www.tssimms.com/our_products/total_product_productlist.asp?a=5&p=products&pr=t&c=&s=&option=&lang=E.

*Primary Examiner* — Robert James Popovics
(74) *Attorney, Agent, or Firm* — Pearne & Gordon LLP

(57) ABSTRACT

A paint caddy includes a base having at least two walls and a pole coupled to and extending upwardly from the base. The base has at least one base support extending between the walls for capturing and supporting a paint tray therebetween. The pole has at least a substantially vertical portion and a substantially horizontal portion, with the substantially horizontal portion serving as a handle for carrying a paint tray. A hook extends from the pole and is positioned below and spaced from the handle.

17 Claims, 6 Drawing Sheets

(56) References Cited

U.S. PATENT DOCUMENTS 2,600,770 A 6/1952 Hofacer
2,883,057 A 4/1959 Richards
3,018,502 A 1/1962 Lossius
3,301,404 A 1/1967 Becker
3,456,663 A 7/1969 Blum
3,731,840 A 5/1973 Beutler et al.
3,741,397 A 6/1973 Gerson et al.
3,822,846 A 7/1974 Jesionowski
3,980,264 A 9/1976 Tomasik
4,005,892 A 2/1977 Williams
4,023,702 A 5/1977 McKnight
4,085,877 A * 4/1978 Hildebrand ..... B44D 3/126 16/436
4,105,564 A 8/1978 Whelan
4,158,631 A 6/1979 Whelan
4,186,903 A 2/1980 Fazakerley
4,264,095 A 4/1981 Lemasters
4,266,746 A 5/1981 Klaiber
4,271,878 A 6/1981 Bologa
4,275,818 A 6/1981 Church
4,294,701 A 10/1981 Whelan
4,399,847 A 8/1983 McRoberts
4,515,188 A 5/1985 Brutsman
D280,685 S 9/1985 Whelan
4,559,140 A 12/1985 Croteau
4,560,127 A 12/1985 Ippolito
4,562,611 A 1/1986 Marttinen
D283,262 S 4/1986 Kline
D286,697 S 11/1986 Marttinen
4,622,146 A 11/1986 O'Brien
4,721,225 A 1/1988 Sobel
4,804,470 A 2/1989 Calvillo et al.
4,853,126 A 8/1989 Whelan
D304,670 S 11/1989 Johnson
4,946,591 A 8/1990 Mealey
4,995,526 A 2/1991 Garrison
5,113,549 A 5/1992 Villiano
5,186,828 A 2/1993 Mankin
5,201,439 A 4/1993 Davies
D349,376 S 8/1994 Hankey, Sr.
5,343,589 A 9/1994 Davenport
5,367,737 A 11/1994 Vosbikian et al.
5,368,728 A 11/1994 Reaves
5,390,888 A * 2/1995 Rogers ..... E06C 7/14 248/110
5,412,835 A 5/1995 Vosbikian et al.
5,425,153 A 6/1995 Vosbikian
5,437,078 A 8/1995 Courcelles
5,473,790 A 12/1995 Desmarais
5,548,864 A 8/1996 Vosbikian et al.
D383,579 S 9/1997 Samson
5,715,564 A 2/1998 Knouse
5,794,671 A 8/1998 Smith
5,816,549 A * 10/1998 Anderson ..... B44D 3/126 248/210
5,913,450 A 6/1999 Runkel
6,027,152 A * 2/2000 Sawdey ..... A45F 5/10 220/759
6,052,860 A 4/2000 Coxsey
6,053,516 A * 4/2000 Ottaway ..... B62B 1/264 280/47.24
6,196,600 B1 3/2001 Miller
6,213,352 B1 4/2001 Boyer, Jr.
6,223,386 B1 5/2001 Morad
6,322,028 B1 11/2001 Fleckenstein
6,419,106 B1 7/2002 Bebak
6,431,392 B1 8/2002 Eisenbeisz
6,436,286 B1 8/2002 Scott
6,494,417 B1 12/2002 Gizzi
6,513,771 B1 2/2003 Tucker
6,715,647 B1 * 4/2004 Ivins ..... B44D 3/126 141/319
6,736,969 B2 5/2004 Milne
6,739,460 B2 5/2004 Gurarslan
6,820,628 B2 11/2004 Larson
6,854,155 B2 2/2005 Herndon
6,880,794 B1 4/2005 Kahn
6,902,060 B2 6/2005 Michelson et al.
7,194,786 B2 3/2007 Gagne
7,210,691 B2 * 5/2007 Puczkowski ..... B25H 3/00 280/40
7,404,229 B2 7/2008 Monahan et al.
7,484,859 B1 2/2009 Burke
7,490,798 B2 2/2009 Mann
7,575,261 B2 8/2009 Gagne et al.
7,736,008 B2 6/2010 Quattrini, Jr.
7,774,893 B2 8/2010 Keane
7,854,341 B2 12/2010 Martin
7,909,377 B2 3/2011 Hopp
8,366,061 B2 2/2013 Rose et al.
D677,849 S 3/2013 Petersen
8,439,053 B2 5/2013 Krzycki
8,636,145 B1 * 1/2014 Toleski ..... B44D 3/12 206/372
8,820,572 B2 9/2014 Miller
8,827,334 B2 9/2014 Endara et al.
D715,011 S 10/2014 Gallardo
9,061,781 B2 6/2015 Palmer
9,085,379 B2 7/2015 Cummins
9,440,485 B2 * 9/2016 Krusoe ..... B44D 3/12
2002/0066844 A1 6/2002 Kelly
2003/0213743 A1 11/2003 Gurarslan
2004/0007514 A1 1/2004 Milne
2004/0159752 A1 8/2004 Vukas
2004/0195280 A1 * 10/2004 Shackelford ..... A45F 5/00 224/148.7
2005/0145757 A1 7/2005 Brown et al.
2005/0161460 A1 7/2005 Depasquale et al.
2005/0194505 A1 * 9/2005 Gagne ..... B44D 3/14 248/310
2005/0217059 A1 10/2005 Keane
2006/0059651 A1 3/2006 Edwards
2006/0082087 A1 * 4/2006 Puczkowski ..... B25H 3/00 280/79.5
2006/0201951 A1 9/2006 Cingel
2006/0261231 A1 11/2006 Gagne et al.
2009/0019659 A1 * 1/2009 Hill ..... B44D 3/126 15/257.06
2009/0169756 A1 7/2009 Joosten
2009/0302563 A1 * 12/2009 Thibault ..... B44D 3/126 280/47.34
2013/0299436 A1 11/2013 Krusoe
2015/0360812 A1 12/2015 Gerson et al.

* cited by examiner

PAINT CADDY

CROSS-REFERENCE TO RELATED APPLICATION

This application is a continuation application of application Ser. No. 13/891,346, filed, May 10, 2013, which claims the benefit of priority to provisional application No. 61/645,284, filed May 10, 2012, the entire disclosures of which are hereby incorporated herein by reference.

FIELD

The present invention generally relates to a paint caddy that can support and improve portability of painting supplies, such as a standard paint tray, a paint roller, a paint can, or other painting tools or accessories.

BACKGROUND

The use of a paint roller and a paint roller tray or pan is well known by both professional and amateur painters. The paint roller conventionally has a handle, an arm extending from the handle that bends three times at right angles, and a roller head disposed on a distal end of the arm. The handle has internal threads and is capable of removably attaching to a pole with a threaded end. A typical paint roller tray is generally rectangular in shape and has a perimeter of upwardly extending walls terminating in a rim. The tray bottom has a flat portion and a slanted portion. The flat portion constitutes a well for containing the bulk of liquid paint, and the slanted portion transitions from the well to a shallow end of the tray. The paint roller is dipped into the well, and excess paint is removed by rolling the roller on the slanted portion. Conventionally, the tray has two legs supporting the shallow end of the tray to keep the tray essentially horizontal and level. The well end of the tray usually rests on the ground or other surface, or it may have two legs shorter than those at the opposite end.

There are several issues with currently available trays. For example, after a painter completes one section, he or she has to move the tray filled with paint to a new section. In order to move the tray, the painter must bend over or crouch, which can put strain on the painter's back or legs. Moreover, a tray filled with paint can be heavy, and grasping it can be awkward. In addition, current trays may be flimsy and can easily tip over, resulting in undesired spilled paint. Due to these issues, rather than moving the tray, a painter may leave the tray in one location and travel back and forth over a long distance.

Furthermore, when a painter wants to take a break, he or she will leave the paint roller in the tray. In order to resume painting, he or she must bend over or crouch to retrieve the roller. It can also be difficult to access other painting accessories, such as a paint brush, painting tape, or a rag.

Accessing the tray can be even more difficult when the painter is on a ladder or stairs. In order to put additional paint on the roller, the painter must either carry the tray up the ladder or stairs, or go down the ladder or stairs to access the tray.

DETAILED DESCRIPTION

Figure 1:
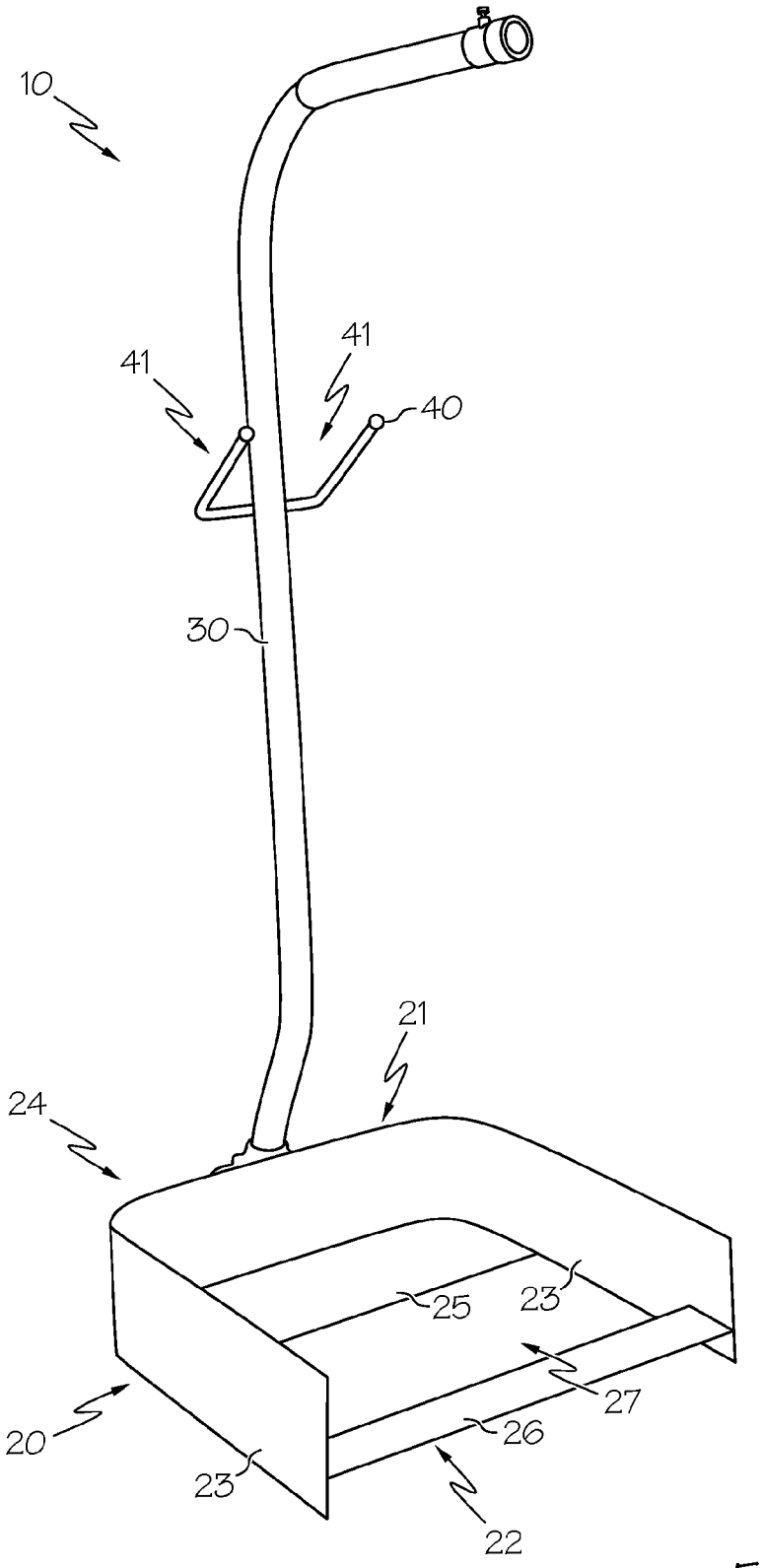
FIG. 1 is a front perspective view of a paint caddy according to one aspect of the invention.

FIGS. 1 to 7 show an example paint caddy 10 having a base 20 and a pole 30. The example paint caddy 10 allows a paint roller tray 100 to be lifted and carried by a painter with one hand without the painter having to bend over or crouch to pick up the tray 100, thereby reducing the risk of paint spills and speeding the application of paint.

Focusing first on the base 20, the base 20 removably receives a standard paint tray 100. The paint tray 100 may include a disposable plastic liner. The base 20 is sufficiently sturdy to support the pole 30, the paint tray 100, a paint roller 200, a paint can 300, and other accessories without tipping. The base 20 can be made of metal, such as aluminum, or another suitable material, such as plastic.

Because the base 20 supports the paint tray 100, the shape of the base 20 substantially mimics the shape of the paint tray 100. In particular, the base 20 has two parallel side walls 23 extending from a first end 21 of the base to a second end 22 of the base 20. At the first end 21, the side walls 23 are connected by a back wall 24 at curved edges, although the edges may be square or shaped otherwise. The lengths and heights of the walls 23 and 24 are dependent on the paint tray 100 and are designed to trap at least part of the paint tray 100. For example, when the paint tray 100 is received within the base 20, part of the paint tray 100, including the feet 110, may extend beyond the side walls 23 at the second end 22. Moreover, the rim 120 of the paint tray 100 may extend over the top edges of the walls 23 and 24 or may be below the rim of the paint tray 100.

Two or more supports 25 and 26 connect the side walls 23 and form a bottom of the base 20. For example, a first support 25 can extend along the back wall 24 between the side walls 23 at the first end 21 of the base, and a second support 26 can extend between the side walls 23 at the second end 22 of the base. Because there is an open space 27 between the supports 25 and 26, the paint caddy 10 is more lightweight. However, the bottom could alternatively be formed from a solid, unitary support without any open space.

Figure 2:
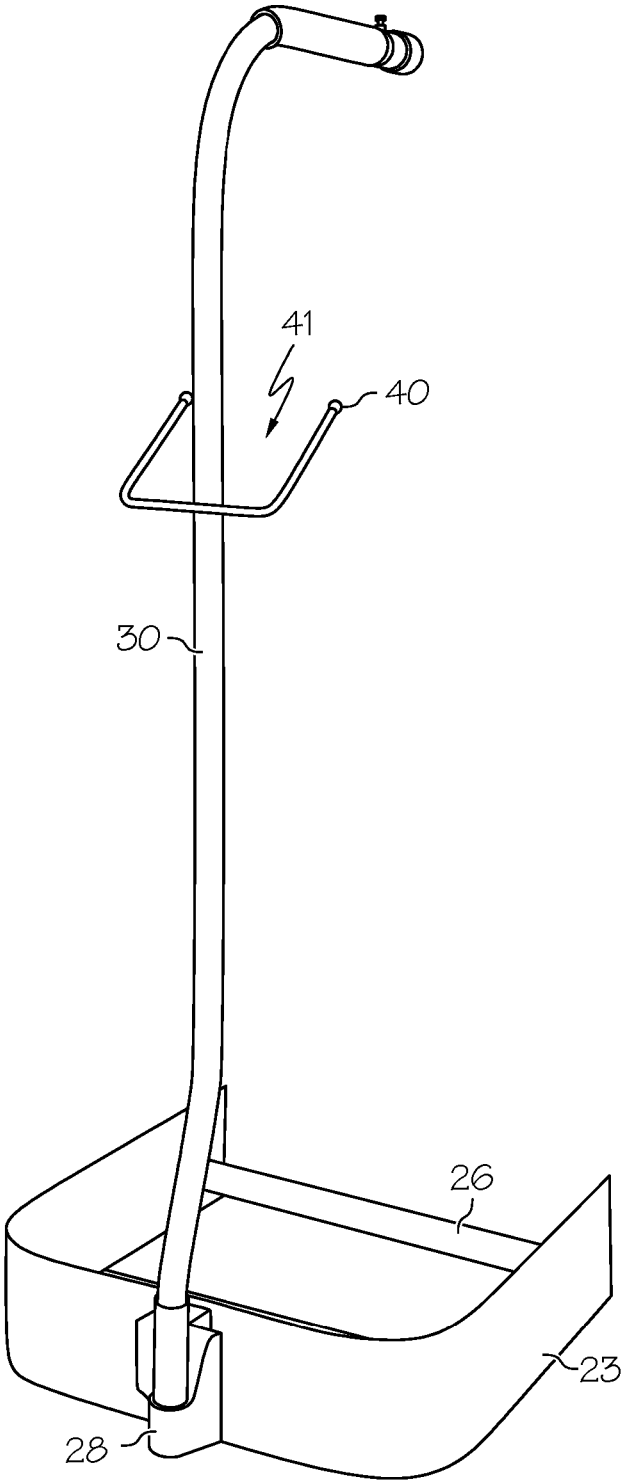
FIG. 2 is a back perspective view of the paint caddy.

In FIGS. 1 and 2, the first support 25 is shown as being even with the bottom of the side 23 and back 24 walls, but could be elevated relative thereto. The second support 26 is shown being elevated relative to the bottom of the side 23 and back 24 walls, but could be the same height as the bottom of the side 23 and back 24 walls. The first support 25 and second support 26 could be at the same height as one another, or at different heights relative to one another.

The paint tray 100 can be received within the base 20 without the use of any fasteners. Alternatively, at least one clip (not shown) could be attached to at least one of the walls 23 or 24 and the tray 100 to more firmly secure the tray 100 in place.

A pole receiving portion 28 is connected to the base 20 in the middle of the back wall. The pole receiving portion 28 can be connected by welding or can be integrally formed with the base 20. The pole receiving portion 28 can be formed as a tubular structure with a hole for releasably receiving the pole 30. The pole 30 can be secured within the pole receiving portion 28 by an interference fit. Alternatively or in addition, a removable fastener could extend laterally through matching through holes in the pole receiving portion 28 and the pole 30. The removable fastener could be a quick release pin, a cotter pin, or a screw. The pole receiving portion 28 can be connected to the back 24 and/or side 23 walls in any known manner.

Focusing now on the pole 30, the pole 30 can be interchangeable with poles of different heights. For example, a standard pole could be 2 to 4 feet tall. A taller pole, from 6 to 12 feet tall, could be preferable to make the paint tray 100 more accessible to a painter on a ladder. Moreover, the pole 30 can be red or another bright color so that it is highly visible, making it less likely that a painter will accidentally trip over the paint caddy 10.

Figure 3:
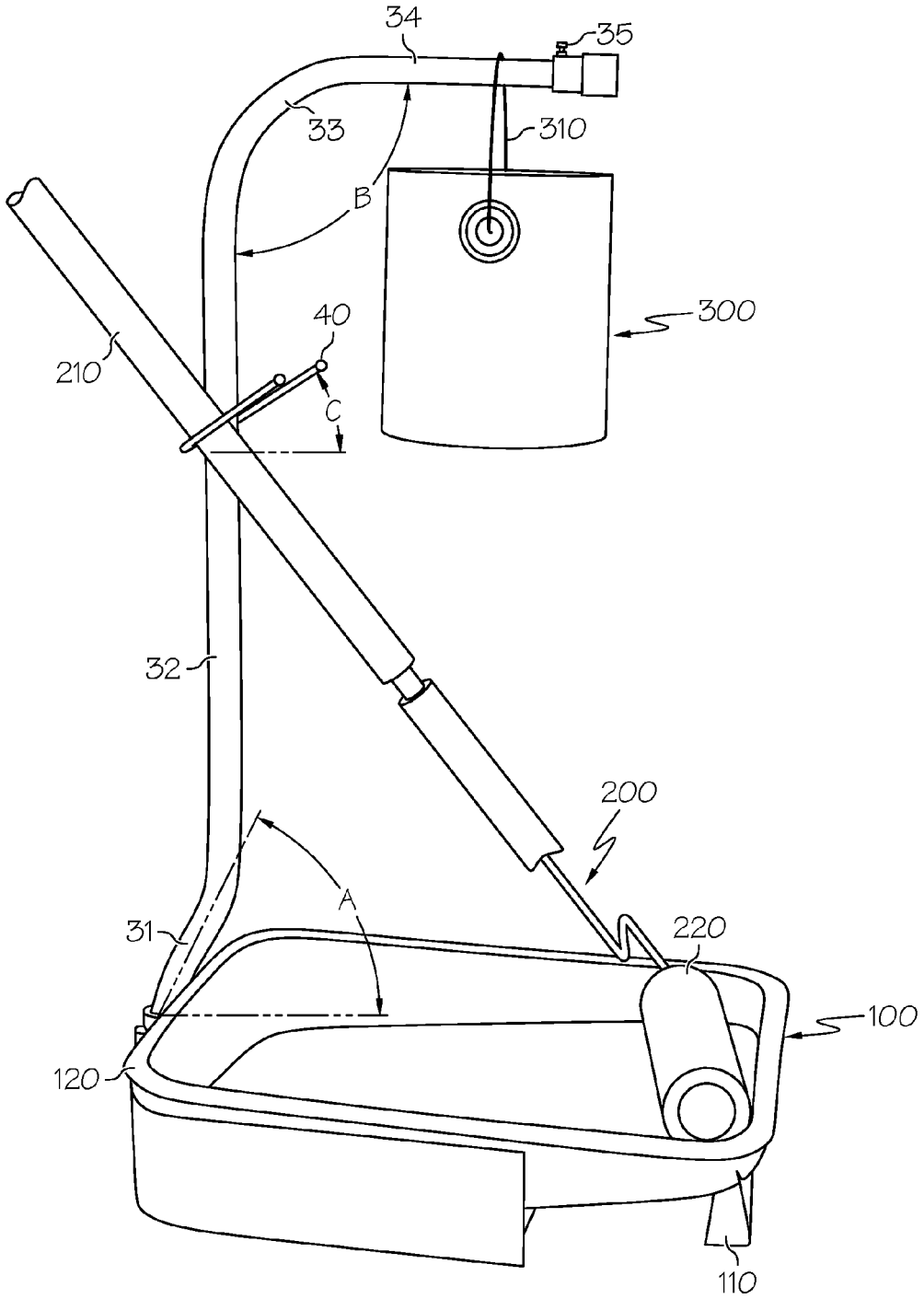
FIG. 3 is a side perspective view of the paint caddy with a paint tray, a paint roller, a paint roller pole, and a paint can on a handle.

The pole 30, shown in FIGS. 1-3, has four sections: a first section 31, a second section 32, a third section 33, and a fourth section (or handle) 34. The first section 31 attaches to the base 20 and is angled at a first angle A that is preferably between 45 and 90 degrees. The angle of the first section 31 makes the paint caddy 10 more structurally sound because it shifts the center of gravity of the paint caddy 10 and various attachments and accessories toward the center of the caddy. The second section 32 extends vertically from the first section 31 and is approximately perpendicular with the ground. The second section 32 supports various attachments, including hooks 40, a funnel ring 50, and a utility cup attachment 60, all of which will be described in greater detail below. The second section 32 and the fourth section 34 are connected by the third section 33. The third section 33 is curved and connects the second section 32 and the fourth section 34 at a second angle B that is approximately 90 degrees. While a pole 30 having varying angles is shown, a straight, vertically extending pole with a perpendicular handle 34 could be utilized. Different angles than those described would be utilized. It may be possible to angle the handle at an angle rather than having the handle be positioned perpendicular to the ground in order to compensate for a vertically straight pole, for example. Thus, other example pole 30 configurations may be utilized.

The fourth section 34 is approximately parallel to ground level and serves as a handle for the paint caddy 10. The handle 34 can be provided with a foam or rubber grip. The orientation and location of the handle 34 allows a painter to easily grasp the handle 34 in order to move or reposition the paint caddy 10. Unlike a traditional paint tray where a painter would have to bend over or crouch to move or reposition the tray using both hands, the paint caddy 10 can be lifted and carried with one hand without bending or crouching. Moreover, the location of the fourth section 34 is more accessible to a painter on a ladder. Unlike a traditional paint tray, the painter would not have to get off the ladder every time he or she wanted to move or reposition the paint tray.

Figure 4:
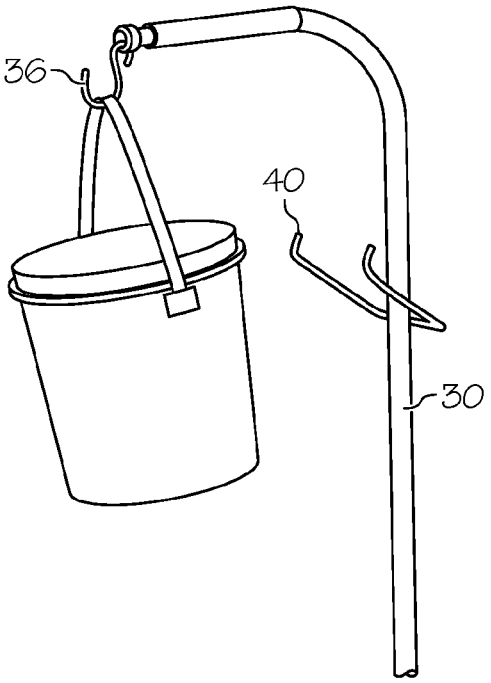
FIG. 4 is a partial perspective view of the paint caddy with a paint can on a hook.

The handle 34 may also support a paint can 300. For example, a handle 310 of a paint can 300 may be placed on the handle 34, and a projection 35 can ensure the paint can 300 remains in position, as shown in FIG. 3. Alternatively, the handle 310 of the paint can 300 may be placed on a hook 36 attached to an end of the handle 34, as shown in FIG. 4. The handle 34 or hook 36 allows a painter to access the paint can 300 without bending over, such as while doing trim work.

Focusing now on the hooks 40, two hooks 40 are shown extending from the second section 32 of the pole at a third angle C. The third angle C is preferably between 10 and 70 degrees, but could be at other angles. The hooks 40 are formed as one U-shaped member that is welded to the pole 30. Alternatively, the hooks 40 can be connected by a bracket, a screw or bolt, or another connecting means. A single hook (not shown) could be alternatively used.

The hooks 40 may serve several functions. For example, one of the hooks 40 can support a paint roller 200 with an attached pole 210. Two roller receiving areas 41 are formed between one of the hooks 40 and the second section 32 of the pole. After a painter has completed a painting operation or wants to take a break, he or she can place the roller head 220 in the shallow section of the tray 100. Next, the painter can rotate the roller pole 210 toward the hooks 40, resting the roller pole 210 in one of the roller receiving areas 41. Unlike a conventional paint tray, the painter does not have to bend over or crouch to retrieve the paint roller 200 and resume painting. In addition, the painter can transport the paint caddy 10, including the roller 200 and tray 100, to a different location. It should also be noted that the paint roller 200 can be supported by one of the hooks 40 while a paint can 300 is simultaneously supported on the handle 34, as shown in FIG. 3.

Figure 6:
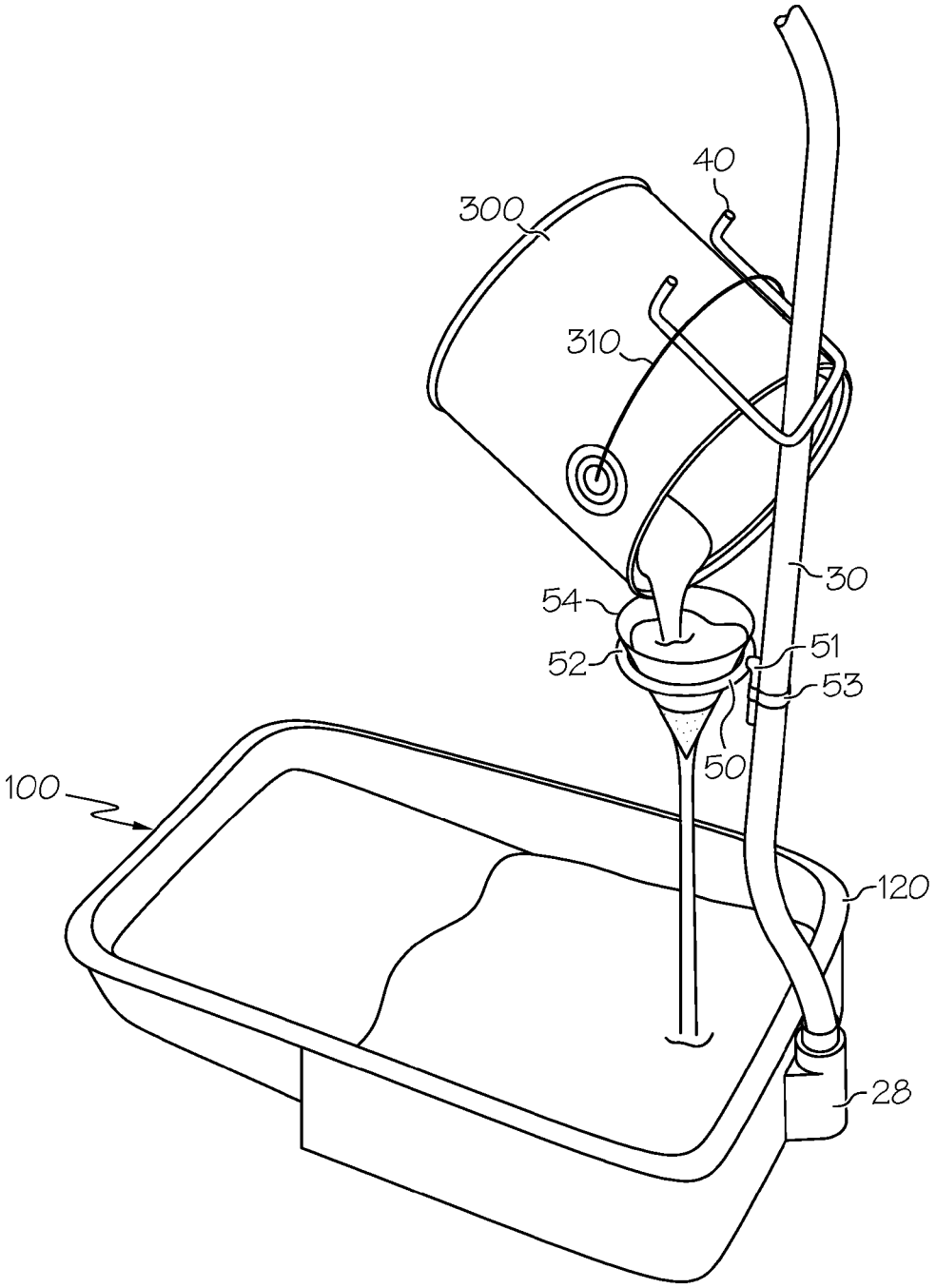
FIG. 6 is a partial perspective view of the paint caddy with a paint can in a draining position and a funnel.

In addition, the hooks 40 can be used to drain a paint can 300. Draining a paint can 300 of the majority of its paint can be a time consuming and tedious process, particularly for thicker paint. However, the hooks 40 can be used to place a paint can 300 in a draining position, as shown in FIG. 6, so that a painter does not have to manually hold the can upside down. The painter puts the metal handle 310 of the paint can 300 on both hooks 40, and then tips the mouth of the paint can 300 toward the second section 32 of the pole until a side of the paint can 300 contacts the hooks 40. The paint can 300 will rest in an angled position, with the mouth of the paint can 300 toward the tray 100, and the paint will drain into the tray 100.

Figure 5:
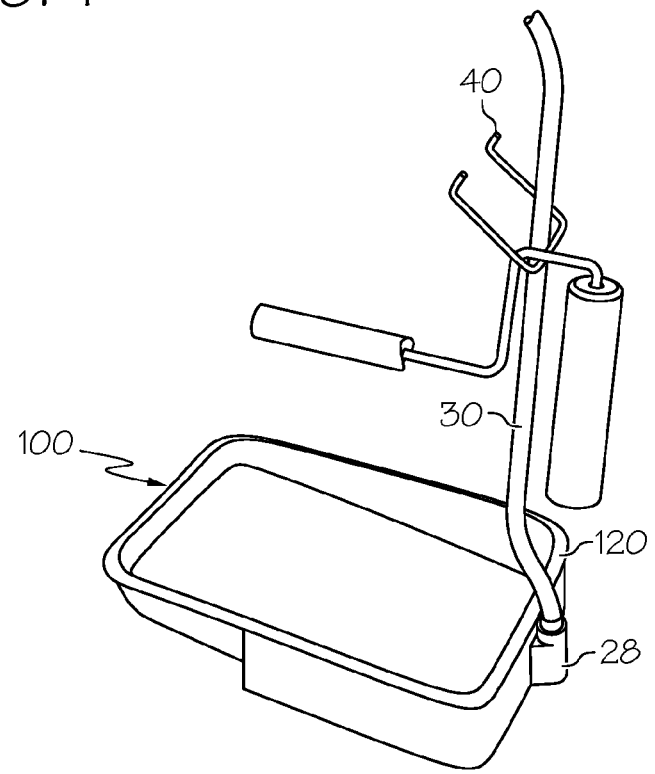
FIG. 5 is a partial perspective view of the paint caddy with a paint roller on a hook.

Moreover, the hooks 40 can be used to support other painting accessories. For example, as shown in FIG. 5, one of the hooks 40 can support a paint roller 200 without a pole, wherein a bend in the arm of the roller 200 rests on one of the hooks 40. In addition, one of the hooks 40 could support a roll of painting tape, wherein the hook 40 extends through the center of the roll. Similarly, one of the hooks 40 could support a pair of scissors, a rag, a putty knife, or another tool.

The hooks 40 are advantageously positioned on the vertical portion 32 of the pole 30 and away from the handle 34. In prior designs, the handle was also used for resting a paint roller handle against the handle of the pole. Since paint rollers can become sullied with paint, this risked exposing the handle to paint. If the paint on the handle went undetected, the user could end up getting paint where they didn't want it. The paint roller handle could also interfere with ease of carrying the handle. Thus, the present design utilizes the vertical section 32 of the pole 30 for the hooks 40 so that the handle 34 is spaced from the hooks 40. Having the hooks 40 on the vertical extent of the pole 30 also allows for varying height for the pole 30. A longer pole is permitted than would have been permitted with prior art designs that utilized the handle for resting the paint roller handle. If desired, the vertical portion 32 of the pole 30 could be adjustable and permit for different heights, which would not have been possible with the prior art designs.

Turning now to the funnel ring 50, shown in FIG. 6, a funnel ring 50 supports a funnel 54. The funnel ring 50 may be attached to the pole 30 in any known manner. The example shown in FIG. 6 includes an L-shaped member 51 connected to a ring member 52. The diameter of the ring member 52 is smaller than the largest diameter of the funnel 54 at an outer edge, so that the funnel 54 will not slide through the ring member 52. The funnel ring 50 can be removably attached to the second section 32 of the pole below the hooks 40 by an adjustable clamping ring 53. A distal leg of the L-shaped member 51 can be inserted between the pole 30 and the adjustable ring 53, with the ring member 52 parallel to the ground. The adjustable ring 53 is then tightened around the pole 30, securing the funnel ring 50 in place. For example, the adjustable ring 53 could be tightened by a tightening screw, a winding member, or a quick release member. The funnel 54 can then be inserted through the ring member 52, with the tip of the funnel below the ring member 52 and the outer edge of the funnel above the ring member 52.

The funnel ring 50 can also be attached to the pole 30 in other ways. For example, a rectangular guide could be attached to the pole by an adjustable ring 53, welding, or another attachment means. The guide would have a central rectangular thru hole or slot for receiving the distal leg of the L-shaped member 51.

The funnel ring 50 and funnel 54 can be used to strain paint. Straining paint is useful to remove lumps, debris, dust, and other abnormalities that may accumulate in the paint. In order to strain paint, the funnel 54 is in the funnel ring 50 and the paint can 300 is in the draining position. Paint from the paint can 300 will drain from the paint can 300 into the funnel 54. The paint will then strain through the funnel 54 and into the tray 100 for use. The funnel may have a filtering portion, if desired.

Figure 7:
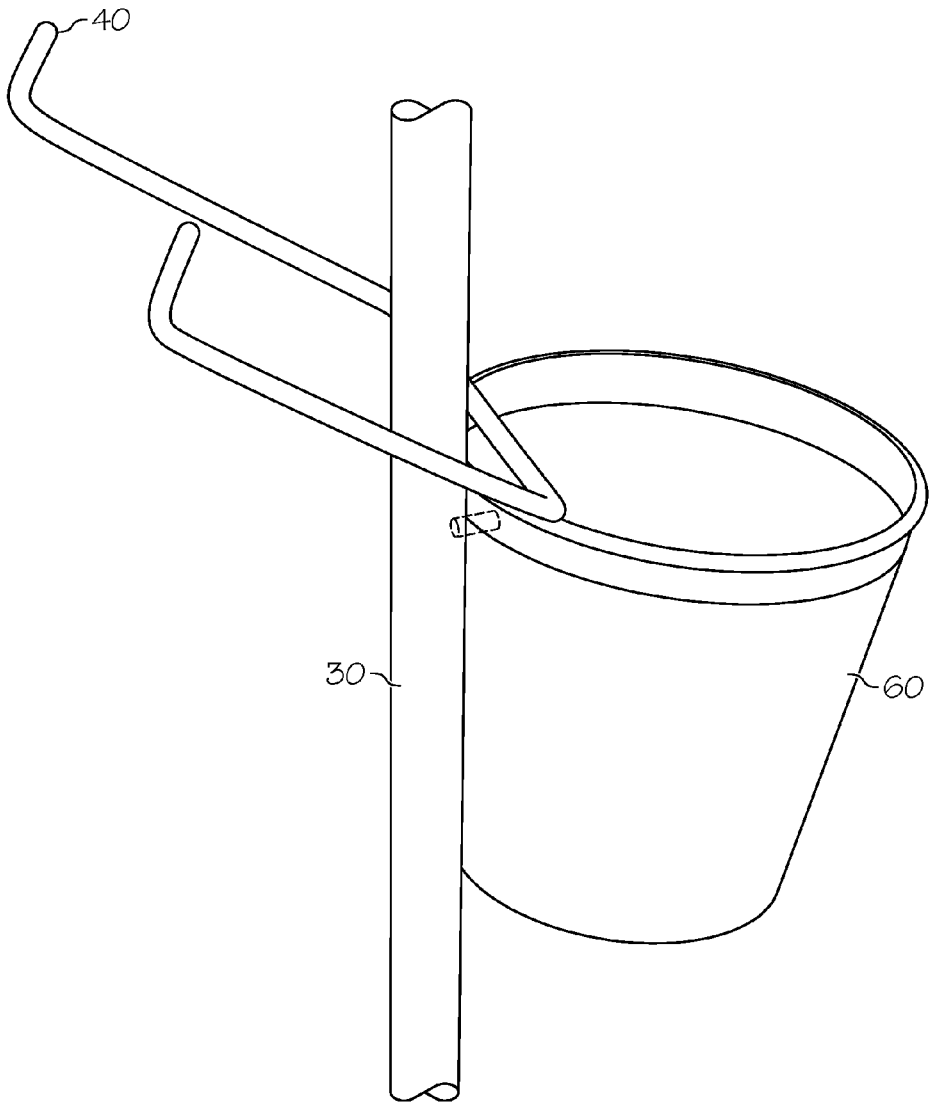
FIG. 7 is a partial perspective view of the paint caddy with a utility cup.

Focusing now on the utility cup 60, the utility cup 60 can be used to hold miscellaneous painting supplies, such as a paint brush, a rag, a scraper, a 5-in-1 tool, screws, a screwdriver, or other tools. The utility cup 60 can be plastic or other materials and may come in a variety of sizes to fit the needs of the painter. The utility cup 60 may be attached to the pole 30 in any known manner and may be removable therefrom for cleaning purposes. As shown in FIG. 7, the utility cup 60 has a hole on one side that connects to a projection on the second section 32 of the pole. The projection could be a screw or a bolt. In order to attach the utility cup 60, the utility cup 60 is pressed against the projection until a portion of the projection extends through the hole. If the projection is a screw, the screw head would extend through the hole. The projection can be located anywhere on the pole 30 so long as the utility cup 60 does not interfere with the other components of the paint caddy 10. For example, the utility cup 60 should not be located directly above the funnel 54 because it would interfere with a straining operation.

In addition to supporting painting tools and accessories during a painting operation, the paint caddy 10 can also be used to transport supplies from job to job. For example, a painter can put a clean tray 100 in the base 20, a paint roller 200 on the hooks 40, and place brushes, rags, and other tools in the tray 100. Then the painter can grasp the handle 34 and transport the paint caddy 10 to a desired location.

Moreover, while the paint caddy 10 has been described for painting uses, it is also capable of supporting tools for other tasks. For example, the paint caddy 10 can be used for wallpapering. The paint tray 100 can hold paste, and the hooks 40 can hold a roll of wallpaper.

A paint caddy has a base with at least two walls and a pole. At least one base support extends between the at least two walls for capturing and supporting a paint tray therebetween. The pole is coupled to and extends upwardly from the base and has at least a substantially vertical portion and a substantially horizontal portion. The substantially horizontal portion of the pole serves as a handle for carrying a paint tray.

The base of the paint caddy may have two side walls and a back wall. The at least one base support may include a front base support, with the front base support extending between the side walls. The pole may include a first section that extends from the base at an angle, a second section is the substantially vertical portion, a third curved section, and a fourth section that is the substantially horizontal portion, with the third curved section coupling the second and fourth sections together. The fourth section may include a gripping portion.

The paint caddy may also include at least one hook coupled to the substantially vertical portion of the pole. The at least one hook may be angled relative to the substantially horizontal section of the pole. The at least one hook may be a double hook. Another hook may be couple to the substantially horizontal portion of the pole.

A funnel stand may be coupled to the substantially vertical portion of the pole. The funnel stand may be positioned below the at least one hook. The base may include a rear base support that extends between the two side walls and that is coupled to the back wall.

A method for draining a can of paint having a handle using the paint caddy described above includes the steps of positioning a paint tray between the at least two walls of the base, positioning a handle of a can of paint around the at least one hook on the substantially vertical section of the pole, tipping a can of paint until the can of paint rests against the vertical section of the pole, and allowing the can of paint to drain into a paint tray.

Another method involves filtering paint in a can of paint having a handle using the paint caddy described above. The method includes positioning a paint tray between the at least two walls of the base, positioning a funnel in the funnel stand, positioning a handle of a can of paint around the at least one hook on the vertical section of the pole, tipping the can of paint until the can of paint rests against the vertical section of the pole such that the paint enters a funnel that is positioned in the funnel stand, and allowing the paint in the can of paint to strain through the funnel into the paint tray.

In another example, a paint caddy includes a base having at least two upwardly extending walls for capturing a paint tray, a pole coupled to the base having a handle for transporting the base, and at least one hook coupled to the pole. The hook is vertically spaced below the handle and extends at least in part over the base.

The pole may have a substantially vertical section and the at least one hook may be positioned on the substantially vertical section. The pole may have a substantially horizontal section, and the horizontal section is the handle. The pole may have a first section, a second section, a third section, and a fourth section. The first section may be attached to the base and may extend at an angle relative to the base between about 45 and 90 degrees. The second section may extend substantially vertically relative to the base. The fourth section may extend substantially parallel to the base. The third section transitions the second section into the fourth section. The at least one hook may be coupled to the second section of the pole.

The paint caddy may also include a funnel stand coupled to the second section of the pole below the at least one hook and a utility cup coupled to the second section of the pole in non-interfering relationship with the hook, funnel stand, and handle of the pole. The base may include two side walls and a back wall, with at least two supports coupled between the walls for capturing a paint tray therebetween. The coupling portion may be coupled to the base in order to capture the first section of the pole.

In yet another example, a paint caddy includes a base, a pole, and at least one hook coupled to the pole. The base has two side walls and a back wall, with at least one base support extending between the two side walls for capturing and supporting a paint tray therebetween. The pole is coupled to the base and extends upwardly therefrom. The pole has a substantially vertical section. The at least one hook is coupled to the vertical section of the pole and extending at least in part over the base.

The paint caddy may also include a handle coupled to the pole for transporting the paint caddy. A coupling may be coupled to the base for capturing a portion of the pole. The pole may include an angled portion extending from the coupling, with the angle portion extending over the base; and the vertical section extending from the angled portion. The paint caddy may also include a utility cup coupled to the pole and a funnel coupled to the pole, with the funnel being positioned below the at least one hook over the base.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A paint caddy comprising:

a base having at least two walls;

at least one base support extending between the walls for capturing and supporting a paint tray therebetween;

a pole coupled to and extending upwardly from the base, the pole comprising:

a first section attached to and extending from the base at an angle relative to the base between about 45 and 90 degrees, whereby the first section extends at least in part over the base;

a second section that is a substantially vertical portion;

a third section that is a transition section; and a fourth section that is a substantially horizontal portion serving as a handle for carrying a paint tray, with the third transition section coupling the second and fourth sections together;

at least one hook coupled to the second section of the pole, wherein the hook is vertically spaced below the handle and extends at least in part over the base; and a funnel stand coupled to the second section of the pole vertically below the at least one hook and vertically above the base.

2. The paint caddy of claim 1, wherein the base has two side walls and a back wall, and the at least one base support comprises a front base support, with the front base support extending between the side walls.

3. The paint caddy of claim 1, wherein the base has two side walls and a back wall, and the at least one base support comprises a rear base support extending between the two side walls and coupled to the back wall.

4. The paint caddy of claim 1, wherein the base has two side walls and a back wall, and the first section of the pole is attached to the back wall of the base.

5. The paint caddy of claim 1, wherein the fourth section comprises a gripping portion.

6. The paint caddy of claim 1, wherein the at least one hook is angled relative to the substantially horizontal section of the pole.

7. The paint caddy of claim 6, wherein the at least one hook is angled upwards between about 10 and 70 degrees.

8. The paint caddy of claim 1, wherein the at least one hook comprises a double hook.

9. The paint caddy of claim 1, further comprising a hook coupled to the substantially horizontal portion of the pole.

10. The paint caddy of claim 1, further comprising a utility cup coupled to the second section of the pole in a non-interfering relationship with the hook, funnel stand, and handle of the pole.

11. The paint caddy of claim 1, wherein the funnel stand comprises a circular funnel ring that is arranged substantially parallel to a ground surface.

12. The paint caddy of claim 1, further comprising a strainer funnel inserted through and retained by the funnel stand, wherein the strainer funnel is capable of filtering paint.

13. The paint caddy of claim 1, wherein the at least one hook coupled to the second section of the pole is configured to support a handle of a can of paint so that the can of paint can be inverted until the can of paint rests against the vertical section of the pole in an angled position with a mouth of the paint can positioned toward said paint tray supported upon the base, whereby the can of paint drains into said paint tray.

14. The paint caddy of claim 13, wherein the funnel stand is in alignment with the at least one hook so that when a strainer funnel is retained by the funnel stand, said draining paint from the can of paint strains through the strainer funnel prior to entering the paint tray.

15. The paint caddy of claim 1, wherein the first section is coupled to the second section, and the third section is coupled between the second and fourth sections and transitions the second section into the fourth section.

16. The paint caddy of claim 15, wherein the third section of the pole is curved.

17. The paint caddy of claim 1, wherein the base has two side walls and a back wall, and wherein the angle of the first section extends the first section forwardly at least in part over the base to thereby shift a center of gravity of the paint caddy away from the back wall and toward a center of the paint caddy.

* * * * *